United States Patent [19]

Ioannesian et al.

[11] 4,077,482

[45] Mar. 7, 1978

[54] THREE CONE ROCK BIT

[76] Inventors: Rolen Arsenievich Ioannesian, naberezhnaya Tarasa Shevchenko, 1/2, kv. 49; Jury Rolenovich Ioanesian, Matveevskaya ulitsa, 18, korpus 2, kv. 63; Polikarp Avtonomovich Paly, ulitsa Zoi i Alexandra Kosmodemyanskikh, 4, korpus V, kv. 316; Leonid Pavlovich Konstantinov, Lomonosovsky prospekt, 23, kv. 495; Jury Evgenievich Vladislavlev, Smolensky bulvar, 6-8, kv. 114, all of Moscow, U.S.S.R.

[21] Appl. No.: 726,810

[22] Filed: Sep. 27, 1976

[51] Int. Cl.[2] ..... E21B 9/08

[52] U.S. Cl. ..... 175/340; 175/376; 175/372

[58] Field of Search ..... 175/339, 340, 231, 376, 175/400, 355, 356, 341

[56] References Cited

U.S. PATENT DOCUMENTS

| | | | |
|---|---|---|---|
| 2,184,067 | 12/1939 | Zublin | 175/340 |
| 3,207,241 | 9/1965 | Neilson | 175/376 X |
| 3,363,706 | 1/1968 | Feenstra | 175/340 |
| 3,397,751 | 8/1968 | Reichmuth | 175/341 |
| 3,495,668 | 2/1970 | Schumacher, Jr. | 175/341 |

*Primary Examiner*—Ernest R. Purser
*Assistant Examiner*—Richard E. Favreau
*Attorney, Agent, or Firm*—Lackenbach, Lilling & Siegel

[57] ABSTRACT

A three cone rock bit comprises legs and freely rotating cutters mounted on the same. The angle $\alpha$ between the projections of the rotational axes of two adjacent cutters on a plane perpendicular to the axis of the bit is more than 120° but less than 170°. A flow nipple to supply drilling fluid is provided in the bit, the outlet thereof being positioned between said two cutters.

3 Claims, 2 Drawing Figures

THREE CONE ROCK BIT

Figure 2:
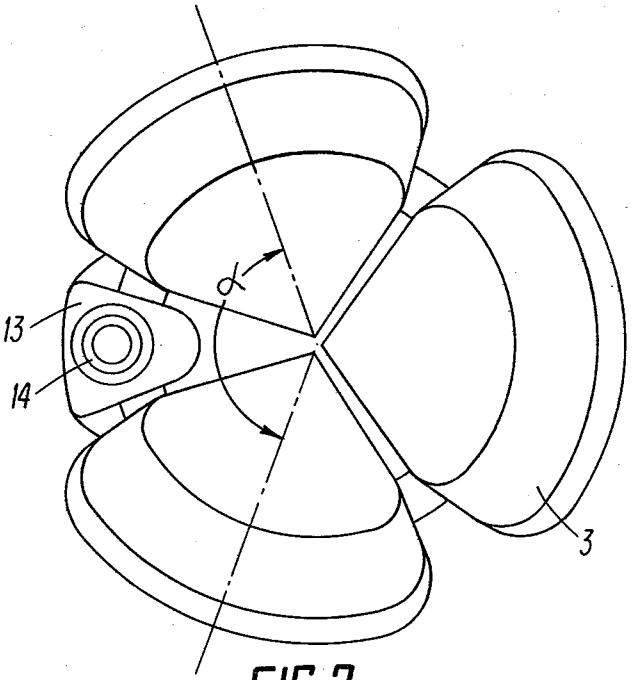

The present invention relates to drilling equipment and particularly to three cone rock bits used in oil and gas well drilling.

A three cone rock bit comprises conical cutters mounted on rolling and/or friction bearings retained in races on the pins of three legs positioned to one another at an angle of 120°. The cutters have on the outer surface thereof rock-breaking members-milled teeth and/or hard-metal inserts. The milled teeth are provided with a hard-faced to increase their wear resistance.

Efficient drilling is provided by timely bottom-hole cleaning and flushing of cuttings toward the surface and by cooling of the cutting elements of the bit generally through flushing. Two types of flushing are provided in rock bits: through one central channel or through three channels positioned between legs. The shape, cross-section, position and number of flushing channels depend on the purpose, type and size of a bit. To increase output or hydraulic horsepower, replaceable mineral-ceramic or metal-ceramic nozzles of various ID are utilized in rock bits, said nozzles building up high pressure drop to provide high nozzle velocity whereby the rock is broken up more efficiently.

However, positioning a flushing channel in the center of a rock bit prevents the high fluid pressure from being effectively used, because the fluid flow affects the nose ends of the cones, rather than directly striking the bottom of the hole. Moreover, the cuttings flushed upwards during drilling are partly involved with the flow and brought on to the central part of the cones, thereby promoting the erosion thereof.

When the circulation is effected through flow nipples positioned between legs, the flushing action of fluid flows on the bottom is also limited. The main disadvantage of these type of bits is a high position of the nozzles of the passages relative to the hole bottom, and because the close spacing of the cutters permits no positioning of said nozzles close to the bottom, the flushing action of the fluid flow on the rock under drilling is decreased and the removal of cuttings from the bottom is reduced.

Besides, with such a position of the flow nozzles, the jet streams strike only the periphery of the bottom, thereby impairing the removal of cuttings from the bottom.

All the known designs of three cone rock bits have a common disadvantage in that the cutters thereof are symmetrical relative to the axis of the bit, so when drilling through hard formations, intense vibration of the drilling string takes place due to the formation of the bottom of potholes oriented at 120° to one another. Vibration impulses are produced by cutters contemporaneously rolling over the potholes.

The object of the present invention is to intensify the flushing action of fluid flow on the bottom.

Another object of the present invention is to improve drilling performance.

Still other object of the present invention is to dimihish vibration of the drilling string, said vibration having a detrimental effect on bit life when drilling in hard formations.

In the three cone rock bit comprising legs having cutters positioned at an angle to one another and a flow nipple supplying drilling fluid to the bottom, the these and other objects are achieved through positioning said nipple between the legs of adjacent cutters positioned in such a way that projections of the rotational axes thereof on a plane perpendicular to the axis of the bit are oriented at an angle more than 120° but less than 170°, the outlet of the nozzle of the channel being positioned between the cutters.

The present three cone rock bit permits intensification of the flushing action of fluid flow on the bottom.

Moreover, the present invention promotes efficient cleaning of the bottom, thereby excluding repeated breaking of rock and hence, taking into account the highly improved flushing action, increasing drilling speed.

When operating with the present bit, vibration of the drilling string decreases greatly due to the asymmetrical position of cutters relative to the bit axis, thereby ruling out the possibility for potholes to form on the bottom.

Figure 1:
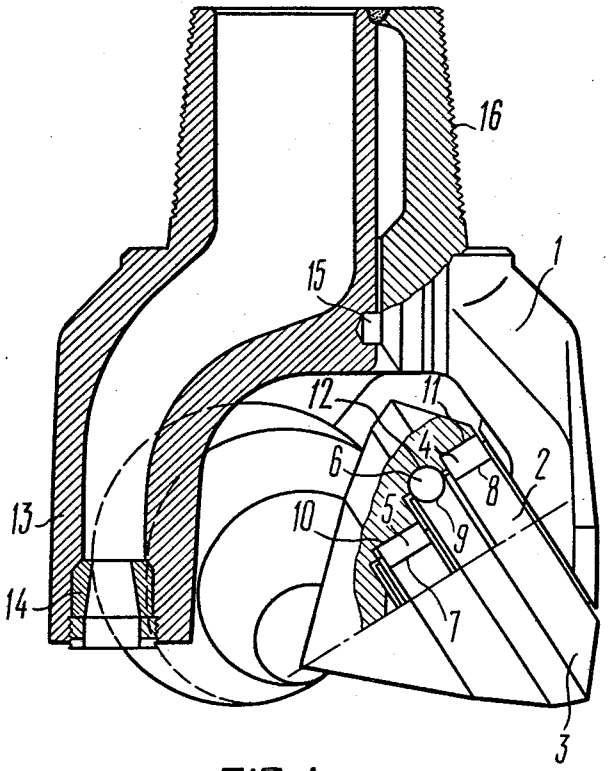

Other objects and advantages of the present invention will be understood as the following detailed description of an example of the present invention is read in conjunction with the accompanying drawing, in which:

FIG. 1 is a longitudinal sectional view through a three cone rock bit, constructed in accordance with this invention; and FIG. 2 is a bottom view of the three cone rock bit of the invention shown in FIG. 1.

Referring now to the drawings for a detailed description of this invention, the three cone rock bit comprises three interwelded legs 1 having pins 2 as integral parts thereof. Cutters 3 are mounted on the pins 2 and fitted with rollers 4, 5 and balls 6. The rollers 4,5 and the balls 6 move in races 8, 7 and 9 respectively made in the pins 2 and in races 11, 10 and 12, respectively made in the cutters 3. As illustrated in FIG. 2, one of the angles between projections of the rotational axes of the adjacent cutters 3 on a plane perpendicular to the axis of the bit is more than 120° but less than 170°, said angle $\alpha$ equalling in particular 144°.

To supply drilling fluid, a flow nipple 13 is provided between the legs of the aforesaid two cutters. The value of the angle $\alpha$ is taken on the condition of the maximum approach of the outlet of the nipple 13 to the bottom. A replaceable hard alloy nozzle 14 is mounted at the outlet of the nipple 13 positioned between the cutters 3.

The position of the nipple 13 in the bit, and hence the distance between the nozzle 14 and the bottom is retained with a pin 15 fixed to one of the legs 1, the nipple 13 being positioned between said legs.

The nozzle 14 can be fitted at any angle to the bottom, depending on type of formation to be drilled.

To attach the bit to a drilling string (not shown), the upper welded part of the legs 1 is provided with a tapered male thread 16.

The legs 1 and cutters 3 of the bit are made of chromium-nickel-molybdenum, chromium-nickel or niclel-molybdenum steel.

The present bit is put into operation as follows:

Prior to rotation of the bit, drilling pumps are put into operation (not shown), and drilling fluid is supplied through the drilling string and the nipple 13 on to the bottom. Thereafter, the drilling string or a turbodrill starts to rotate the bit, the cuttings 3 rolling over the bottom and breaking up rock. Cutters are flushed into the annular space by a fluid flow outgoing from the nozzle 14 under the pressure of 100 -150 atm and at a speed of up to 200 m/sec.

The speed of the flow outgoing from the nozzle 14 is selected depending on the type of formation to be drilled.

What is claimed is:

1. An asymmetric three cone rock bit for drilling holes comprising: a bit head or body having an upwardly extending shank formed about a vertical axis or central axis of the bit body, and three horizontally spaced, downwardly projecting legs extending from said bit body; and generally conically shaped cutters of the same diametric size being journalled on each of said legs and extending downwardly and inwardly therefrom at the same cutter angle, each of said cutters being mounted on a leg for rotation about an axis projecting at an acute angle with respect to said vertical or central axis; said cutters and legs being asymmetrically positioned relative to each other wherein two of said cutters have rotational axes intersecting a plane extending normal to said vertical or central axis at two points spaced from each other by a greater distance than said points are each spaced from a third point of intersection with said plane of the rotational axis of the third cutter, and wherein said three points of intersection are used to define a circle in said plane; said two points of intersection are angularly spaced circumferentially from each other at an angle greater than 120° but less than 170°; and a single flow nipple or nozzle means for supplying of a flushing fluid extending downwardly between said two cutters to a position spaced close to the bottom of the drill hole, whereby the flushing action of fluid flow on the hole bottom is intensified and drilling performance is improved.

2. The asymmetrical three cone rock bit according to claim 1, wherein said angle equals about 144°.

3. An asymmetrical three cone rock bit according to claim 1, wherein said single flow nipple or nozzle means is adjustable so as to be fitted at an angle to the bottom of a drill hole.

* * * * *